United States Patent [19]

Rachi

[11] Patent Number: 4,857,900

[45] Date of Patent: Aug. 15, 1989

[54] DISPLAY DEVICE WITH COLOR CORRECTION

[75] Inventor: Masahiro Rachi, Tokyo, Japan

[73] Assignee: Canon Kabushiki Kaisha, Tokyo, Japan

[21] Appl. No.: 808,087

[22] Filed: Dec. 12, 1985

[30] Foreign Application Priority Data

Dec. 15, 1984 [JP] Japan ..... 59-263742
Dec. 15, 1984 [JP] Japan ..... 59-263743

[51] Int. Cl.[4] ..... G09G 1/28

[52] U.S. Cl. ..... 340/703; 315/169.3; 358/27; 340/701

[58] Field of Search ..... 315/169.3, 169.4, 169.1, 315/169.2; 340/703, 704, 718, 760, 761, 767, 776; 358/27, 28

[56] References Cited

U.S. PATENT DOCUMENTS 3,919,712 11/1975 Izumisawa et al. ..... 358/27
4,066,929 1/1978 Okamoto et al. ..... 340/703 X
4,090,189 5/1978 Fisler ..... 315/169.1
4,158,794 6/1979 Sandler ..... 315/169.1
4,204,209 5/1980 Suehiro ..... 315/169.1
4,278,917 7/1981 Kobori ..... 315/169.1
4,303,917 12/1981 Kishino et al. ..... 315/169.4
4,367,464 1/1983 Kurahashi et al. ..... 340/701
4,495,445 1/1985 Turney ..... 315/169.4
4,559,480 12/1985 Nobs ..... 315/169.4
4,652,869 3/1987 Vakil ..... 340/703

*Primary Examiner*—Palmer C. DeMeo
*Assistant Examiner*—Mark R. Powell
*Attorney, Agent, or Firm*—Fitzpatrick, Cella, Harper & Scinto

[57] ABSTRACT

A display device includes a light emission unit having a plurality of colors for radiating light by feeding electrical power thereto; a drive unit for feeding electrical power to the light emission unit; and a control unit for controlling the drive unit based on the color to be illuminated by the light emission unit.

8 Claims, 4 Drawing Sheets

DISPLAY DEVICE WITH COLOR CORRECTION

BACKGROUND OF THE INVENTION

1. Field of the Invention

The prevent invention relates to a display device for displaying patterns in a plurality of colors, and more particularly to a display device capable of compensating the difference of brightness caused by the light radiation output difference of colors.

2. Description of the Prior Art

In a conventional display device for displaying patterns made of a dot matrix or segments with a plurality of colors, each pixel has been driven on the same power supply level. Even if the same amount of electrical power is supplied to each pixel, the light emission output varies depending upon the color to be displayed. Therefore, there is a difference or brightness between colors so that dark pixels are visually unfavorable as compared with bright pixels. With such a prior art disadvantage, visual sensation is adversely affected so the user of the display device feels uncomfortable and considers the device unreliable.

SUMMARY OF THE INVENTION

It is an object of the present invention to provide a display device wherein drive means is controlled based on the color of light radiated by energizing light emission means.

It is another object of the present invention to provide a display device wherein although different color radiators are used, the same brightness is obtained by controlling the time duration of power to be supplied to the radiator, based on the color of light radiated by energizing light emission means.

It is a further object of the present invention to provide a display device wherein although different color radiators are used, the same brightness is obtained by controlling the amount of supply power, based on the color of light radiated by energizing the light emission means.

It is a still further object of the present invention to provide a display device wherein the drive condition is changed for each of a plurality of light radiators.

It is another object of the present invention to provide a display device having a plurality of different color radiators each having an anode, cathode and grid wherein the time duration of driving the anode is controlled based on the color of each radiator to be energized.

DETAILED DESCRIPTION OF THE PREFERRED EMBODIMENTS (First Embodiment)

A first embodiment of the present invention will be described with reference to the accompanying drawings.

Figure 1:
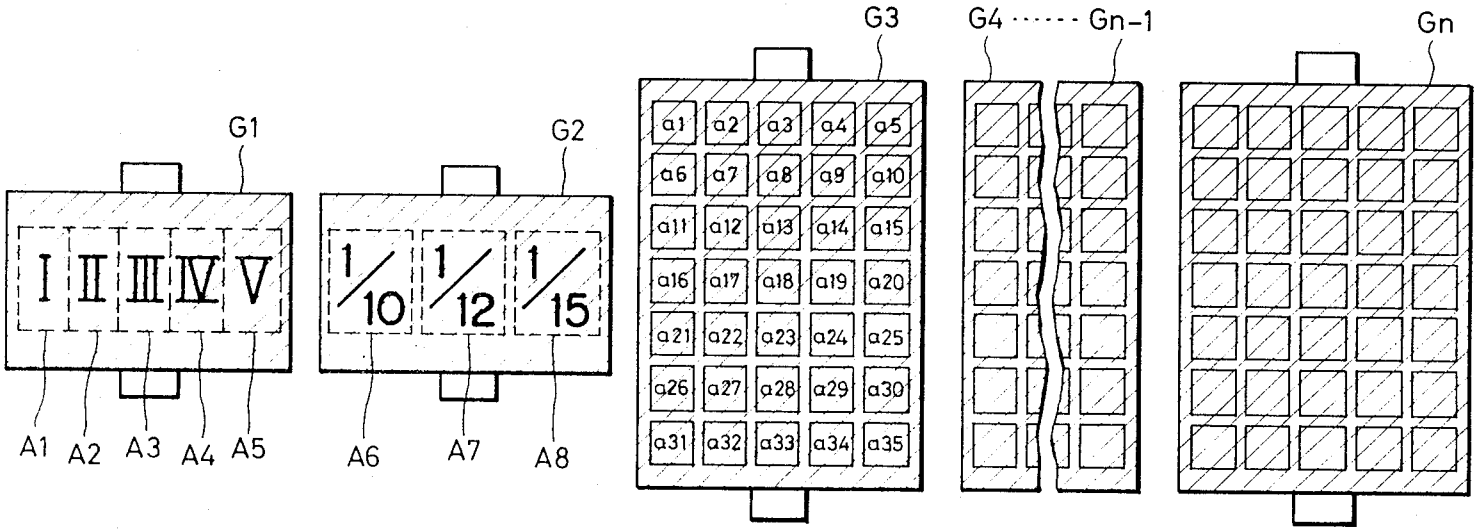
FIG. 1 is a schematic view showing the positional relationship between anodes and grids relative to the display patterns of a fluorescent display tube according to an embodiment of the invention.

FIG. 1 shows the display patterns of a fluorescent display tube, the patterns being illuminated in two different colors. As shown in FIG. 1, the display patterns (I to V, 1/10, 1/12, 1/15) covered with grids G1 and G2 emit red color light, while the display patterns (dots of 5×7 dot matrix) covered with grids G3 to Gn emit green color light. If the fluorescent display tube is energized on the same power condition for both red and green colors, green light becomes brighter than red light. In this embodiment, the amount of supply power to the red display patterns is made greater to compensate for the difference of light emission output.

Figure 2:
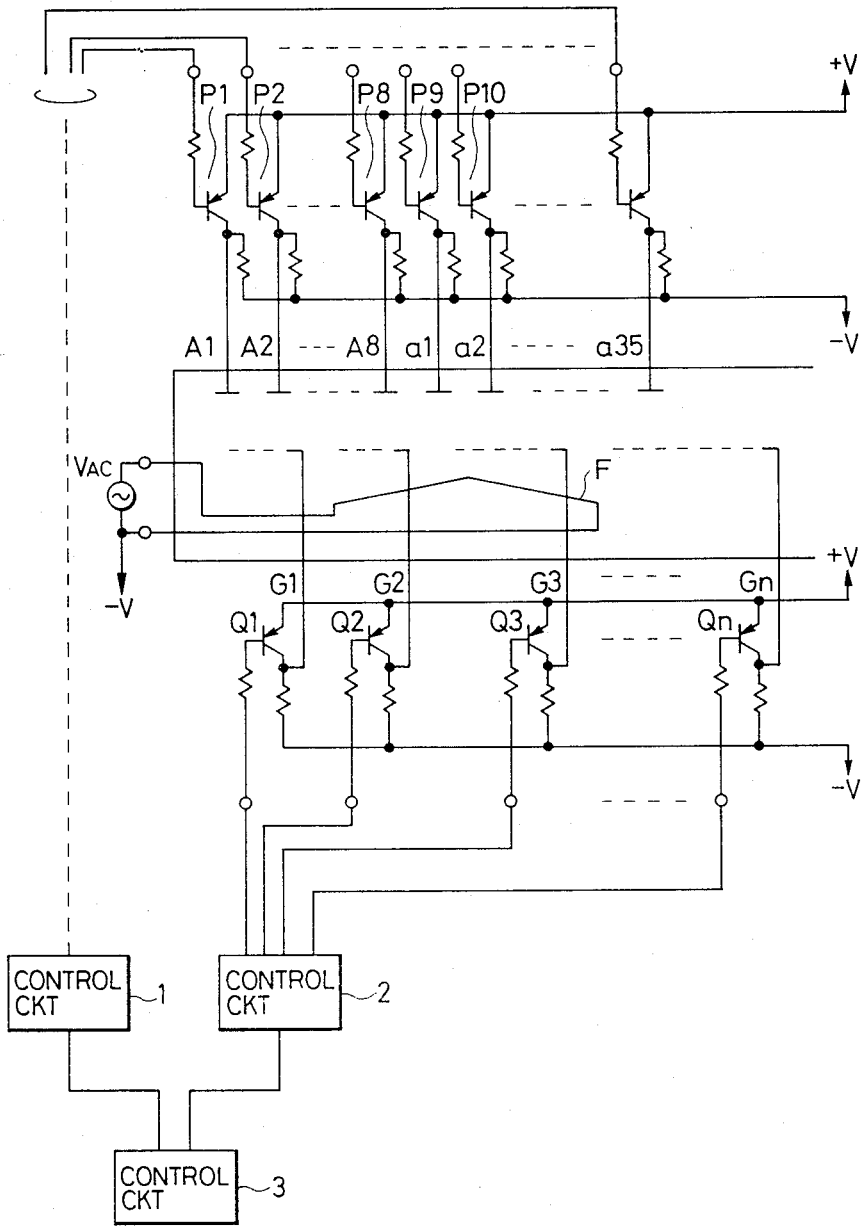
FIG. 2 is a circuit diagram of the drive circuit of the fluorescent display tube according to the invention.

FIG. 2 shows the drive circuit for the fluorescent display tube of the present invention. Red emission anode sections A1 to A8 correspond respectively to the display patterns I to V, 1/10, 1/12, 1/15. Green emission anode sections a1 to a35 correspond respectively to the dots of the display patterns of 5×7 dot matrix. The cathode is biased to a negative voltage −V, and the filament portion F is heated by an AC voltage $V_{AC}$ to emit thermoelectrons. Grids G1, G2, G3, . . . , Gn control the amount of thermoelectrons passing from the cathode to the anode. Each grid controls plural adjacent anodes at the same time. In the figure, for example, grid G1 controls anodes A1 and A2, grid G2 controls anode A8, and grid G3 controls anodes a1 and a2. P1, P2, . . . , P43 represent anode drive transistors, and Q1, Q2, . . . , Qn represent grid drive transistors.

It is assumed here that "1/15" (corresponding to A8) of a red color and the second dot (corresponding to a2) from the left on the upper most row in the green dot matrix are illuminated. To this end, transistors Q2 and Q3 of the drive circuit for grids G2 and G3, among those grids controlling thermoelectrons to the anodes, are turned on. Simultaneously therewith, transistors P8 and P10 of the drive circuit for anodes A8 and a2, among those anodes A1 to A8, a1 to a35, are turned on to apply +V voltage to those anodes A8 and a2. A control circuit 1 controls to turn on and off transistors P1, P2, . . . , P43, a control circuit 2 controls to turn on and off transistors Q1, Q2, . . . , Qn, and a control circuit 3 controls both circuits 1 and 2 to dynamically display the display patterns in a time-shared way.

Figure 3:
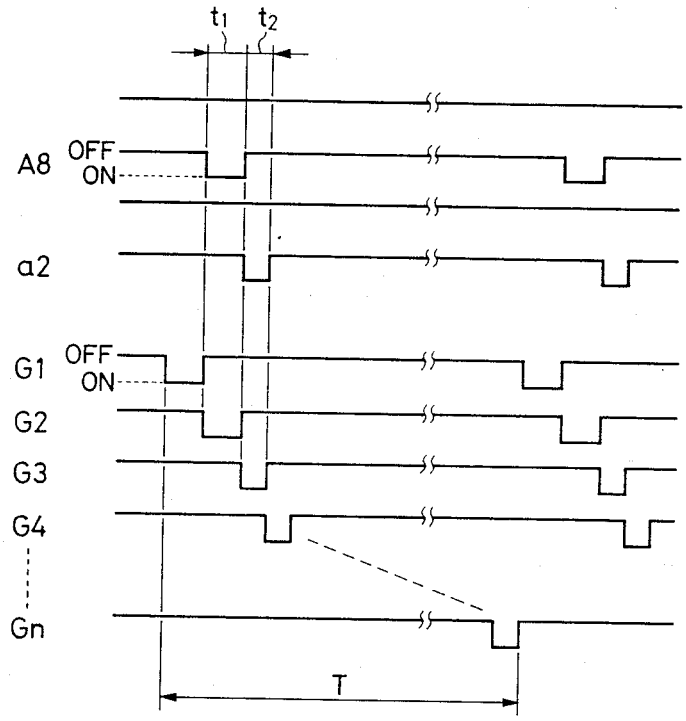
FIG. 3 is a timing chart of signals to be supplied to the drive circuit.
Figure 4:
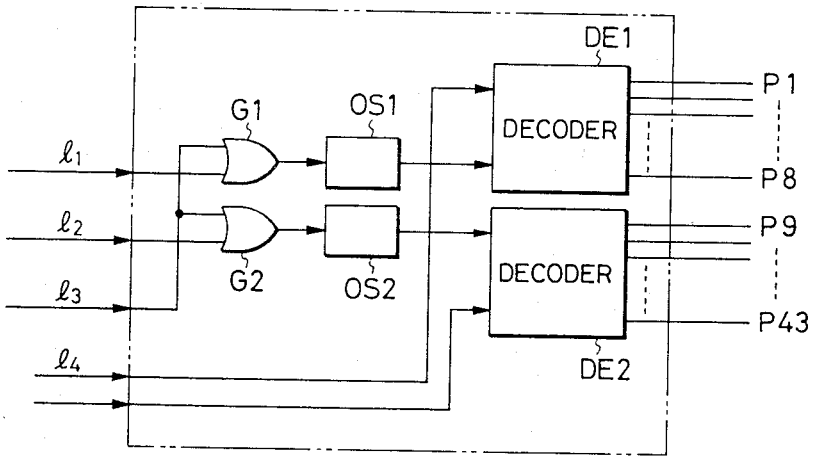
FIG. 4 is a detailed construction of the control circuit for controlling to turn on and off transistors P1 to P43.

The control circuit 1 is constructed as shown in FIG. 4. In the figure, G1 and G2 represent gates. One-shot timers OS1 and OS2 output time signals for use in compensating for scattering of the luminance. Decoders DE1 and DE2 send selection signals for transistors P1 to P43. The operation of the control circuit 1 constructed as such is as follows. As shown in FIG. 4, an ON/OFF signal $l_4$ from the control circuit 3 is outputted via decoders DE1 and DE2 to transistors P1, P2, . . . , P43. Discrimination signals $l_2$ and $l_1$ from the control circuit 3 are used for illuminating either the red color or the green color. A sync signal $l_3$ from the control circuit 3 is for actuating transistors P1, P2, . . . , P43. To illuminate the red color, at the timings signals $l_1$ and $l_3$ turn on, gate G1 is turned on to generate from one-shot timer OS1 the time duration $t_1$ (FIG. 3) necessary for illumination of red color. Similarly, at the timings signals $l_2$ and $l_3$ turn on, gate G2 is turned on to generate from one-shot timer OS2 the time duration $t_2$ (FIG. 3) necessary for illumination of green color.

To dynamically display the display patterns in a time-shared way, a pulse waveform having a certain conduction ratio (duty cycle) is input from the control circuit 1 to the base input terminals of the transistors of the anode drive circuit. The relation between the pulse timings and their conduction time durations, and the conduction timings to the grids and their conduction time durations are shown in FIG. 3.

In FIG. 3, while anode A8 (for display pattern "1/15") and grid G2 are turned on at the same timing and maintained on for time duration $t_1$, "1/15" of a red color is illuminated. While anode a2 (for a second dot from the left on the uppermost row in the dot matrix) and grid G3 are turned on at the same timing and maintained on for time duration $t_2$, the dot corresponding to anode a2 is illuminated. The conduction ratio (duty cycle) of grids G1 and G2 for red color display becomes $t1/T$, while that of grids G3 to Gn for green color display becomes $t2/T$, where T is the period of scanning grids G1 to Gn.

To set the on-time period as $t1=2\ t2$, then $t1/T=2\ t2/T$ is established. Therefore, the red color display section is supplied with an electrical power twice as long as the green color display section. Generally, the light emission efficiency of green color is higher than that of red color. Assuming that the light radiation efficiency is 2 (green) : 1 (red), the same light radiation output is obtained for red and green colors if electrical power is supplied in proportion of 1 (green) : 2 (red). In the above embodiment, although the conduction time ratio (duty cycle) has been changed, it is also possible to change the conduction voltage or current ratio to vary the amount of supply power.

As seen from the foregoing description of the embodiment, in a display device capable of displaying patterns in a plurality of colors, the amount of supply power is changed based on the color to be displayed and the light radiation output of each color is made adjustable. Therefore, even if the light radiation efficiency differs for each color, the light radiation output can be made at the same level. Furthermore, it is possible to obtain displays of different brightness by intentionally making the light radiation output differ for each color by setting the light radiation output ratio as desired.

(Second Embodiment)

Figure 5:
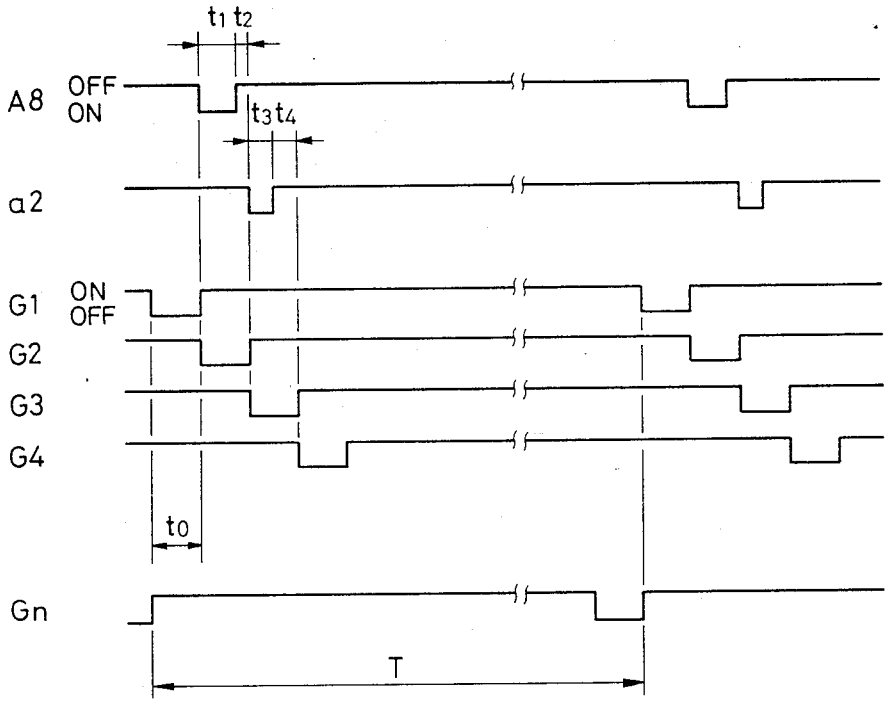
FIG. 5 is a timing chart of signals to be supplied to the drive circuit according to a second embodiment of the invention.

A second embodiment is shown in FIG. 5, wherein, in the display device shown in FIGS. 1, 2 and 4, the relationship is modified between the pulse timings and their condition time durations and the conduction timings to the grids and their conduction time durations.

Referring to FIG. 5, each grid G1 to Gn is maintained on for a constant time duration $t_0$ in a time-shared way. The conduction period for grids G1 to Gn becomes a constant value of $T_0 \times n = T$. To energize anode A8 (for display pattern "1/15"), anode A8 and grid G2 are turned on at the same timing and maintained on for time duration $t_1$ to illuminate a red color. The on-time $t_1$ may take $t_0$ at a maximum. Therefore, the on-time $t_1$ may take any value within $t_1+t_2=t_0$ by adjusting the off-time $t_2$ based on the light radiation efficiency.

Similarly, when anode a2 (for the second dot from the left on the uppermost row in the dot matrix) and grid G3 are turned on at the same timing, the dot corresponding to anode a2 is illuminated in green. The illumination time duration equals the on-time $t_3$ of anode a2, and the off-time $t_4$ has a relation of $t_3+t_4=t_0$. The conduction ratio (duty cycle) of grid G1 and G2 for the red color display patterns becomes $t_1/T$, while that of grids G3 to Gn for the green color display patterns becomes $t_3/T$, where T is the period of scanning grids G1 to Gn.

To set the on-time as $t_1=2\ t_3$, then $t_1/T=2\ t_3/T$ is established. Therefore, the red color display section is supplied with an electrical power twice as long as the green color display section. Generally, the light radiation efficiency of green color is higher than that of red color. Assuming that the light radiation efficiency is 2 (green) : 1 (red), the same light radiation output is obtained for red and green colors if electrical power is supplied in proportion of 1 (green) : 2 (red).

In the above embodiment, the grid selection time duration is fixed at $t_0$, whereas the on-time of the anode, i.e., $t_1$ and $t_3$ is made variable. Thus, by changing the on-time for each pixel with the constant conduction period T, the difference in brightness, to be caused by the light radiation efficiency difference between colors, can be compensated.

As seen from the foregoing description of the embodiment, in a display device capable of displaying patterns in a plurality of colors, the amount of supply power is changed based on the color to be displayed and the light radiation output of each color is made adjustable. Therefore, even if the light radiation efficiency differs for each color, the light radiation output can be made at the same level, thereby eliminating flicker in the display. Furthermore, in case that the light radiation output is intentionally made to differ for each color to obtain displays of different brightness, a desired light radiation output ratio may be obtained without producing any flicker is display.

I claim:

1. A display device comprising:

a plurality of light emission units each having an anode emission member, a cathode member and a grid member, the light emission efficiencies in the light emission units being different for respective colors;

drive means for supplying electrical power to said light emission units; and control means for controlling the drive means so that a small electrical power is supplied to the anode emission member and the grid member in the light emission units having the higher light emission efficiency while a large electrical power is supplied to the anode emission member and the grid member in the light emission units having lower light emission efficiency, and the electrical power supplied to the anode emission member being proportional to that supplied to the grid member.

2. A display device according to claim 1, wherein said control means control said device means so that the supply time of the voltage supplied to the anode emission member of said light emission units is proportional to the voltage supplied to the grid member.

3. A display device according to claim 1, wherein said light emission units are fluorescent display tubes.

4. A display device according to claim 1, wherein said control means controls said drive means so as to supply the electrical power to a plurality of light emission units having the different colors in inverse ratio with the light emission efficiency.

5. A display device comprising:

a plurality of light emission units each having an anode emission member, a cathode member and a grid member, the light emission efficiencies in the light emission units being different for respective colors;

drive means for supplying electrical power to said light emission units; and control means for controlling said drive means so that a constant electrical power is supplied to the grid member of said light emission units, and a small electrical power is supplied to the anode emission member of said light emission units having the higher light emission efficiencies while a large electrical power is supplied to the anode emission member of said emission units having the lower light emission efficiencies.

6. A display device according to claim 5, wherein said control means controls the apply time of the voltage applied to the anode emission member in said light emission units.

7. A display device according to claim 5, wherein said light emission units are fluorescent display tubes.

8. A display device according to claim 5, wherein said control means controls said drive means so that the electrical power is supplied to a plurality of light emission units having the different emission efficiencies in inverse ratio with the light emission efficiency.

* * * * *

UNITED STATES PATENT AND TRADEMARK OFFICE

CERTIFICATE OF CORRECTION

PATENT NO. : 4,857,900

DATED : August 15, 1989

INVENTOR(S) : Masahiro Rachi

It is certified that error appears in the above-identified patent and that said Letters Patent is hereby corrected as shown below:

COLUMN 1:

Line 68, "invention;" should read --invention.--

COLUMN 2:

Line 38, "upper most row" should read --uppermost row--.

COLUMN 3:

Line 51, "condition" should read --conduction--.

COLUMN 4:

Line 1, "grid G1 and G2" should read --grids G1 and G2--.

Line 30, "in case" should read --in the case--.

UNITED STATES PATENT AND TRADEMARK OFFICE

CERTIFICATE OF CORRECTION

PATENT NO. : 4,857,900

DATED : August 15, 1989

INVENTOR(S) : Masahiro Rachi

It is certified that error appears in the above-identified patent and that said Letters Patent is hereby corrected as shown below:

COLUMN 4

Line 50, "having lower" should read --having the lower--.

Signed and Sealed this

Sixteenth Day of October, 1990

*Attest:*

*Attesting Officer*

HARRY F. MANBECK, JR.

*Commissioner of Patents and Trademarks*